US005765796A

United States Patent [19]

Lanús

[11] Patent Number: 5,765,796

[45] Date of Patent: Jun. 16, 1998

[54] ROTATABLE HOLDER FOR KITCHEN APPLIANCES

[76] Inventor: Alfred Lanús, 1378 SW. 21st Ter., Miami, Fla. 33145

[21] Appl. No.: 542,472

[22] Filed: Oct. 5, 1995

[51] Int. Cl.[6] ..... A47B 95/00

[52] U.S. Cl. ..... 248/349.1

[58] Field of Search ..... 248/349.1, 425, 248/430, 429, 131; 439/13, 20, 21, 27, 29; 108/20, 22, 50, 94, 103, 104, 139, 93, 141

[56] References Cited

U.S. PATENT DOCUMENTS

| | | | |
|---|---|---|---|
| 1,608,704 | 11/1926 | McConaha | 108/20 |
| 3,652,972 | 3/1972 | Kreider | 248/349.1 |
| 4,106,830 | 8/1978 | Sorgatz | 339/8 R |
| 4,237,796 | 12/1980 | Gordon et al. | 108/20 |
| 5,190,261 | 3/1993 | Tetting | 248/349.1 |
| 5,255,886 | 10/1993 | Wang | 248/349.1 |
| 5,421,271 | 6/1995 | Sui | 108/20 |
| 5,535,684 | 7/1996 | John | 108/50 |

*Primary Examiner*—Ramon O. Ramirez
*Assistant Examiner*—Gwendolyn W. Baxter
*Attorney, Agent, or Firm*—Malloy & Malloy, P.A.

[57] ABSTRACT

The invention relates to a rotatable holder for supporting numerous small kitchen appliances in a sturdy and storage-efficient manner, to allow for rotation of the holder so as to facilitate use of one or more selected appliances thereon and to allow each small kitchen appliance to remain plugged in and ready for use. The holder of the present invention comprises a circular base, a circular tray structured and adapted to be positioned on top of the base and rotated relative thereto, and means for rotatably connecting the tray to the base. The connecting means comprise mating male and female connector structure mounted to the base and the tray and further, include means for receiving a supply of electrical power through the base and for transmitting the electrical power to the tray. The tray includes an upstanding electrical core mounted to an upper surface in electrical communication with the connecting means and further, includes a plurality of electrical outlets operably connected thereto and in electrical communication therewith. Each of the plurality of electrical outlets is axially disposed about the core a pre-determined distance above the tray. It will therefore be appreciated that a number of small kitchen appliances may be stored on the tray of this invention and that each appliance may remain plugged in to one of the plurality of electrical outlets, ready for use.

18 Claims, 4 Drawing Sheets

ROTATABLE HOLDER FOR KITCHEN APPLIANCES

BACKGROUND OF THE INVENTION

1. Field of the Invention

The present invention relates to a rotatable holder for kitchen appliances, and is specifically adapted to support numerous small kitchen appliances in a sturdy manner and in a storage efficient manner, and to allow for rotation of the holder so as to facilitate use of a selected appliance thereon, or use of more than one appliance thereon, simultaneously.

2. Description of the Related Art

In households that exist today, it is common to find numerous appliances in the kitchen. While there are large appliances, such as refrigerators, stoves, microwave ovens, and the like, these are few in number compared to the small appliances that abound in contemporary kitchens. For example, one will typically find at least several of the following small electric appliances in current kitchens: food processors, toasters, coffee makers, espresso coffee makers, coffee grinders, toaster ovens, electric can openers, juice makers, blenders, electric beaters, juice makers, bread makers, ice cream makers, irons, radios, televisions, cordless phones, etc. A common problem that arises with having all of these small appliances in a kitchen is finding sufficient storage room within the kitchen, either on the counter, in a closet, in a pantry, or in a cupboard. While it would be preferable to have sufficient counter space in the kitchen for the various small devices, and ideally, a counter situated near an electrical outlet for easy use of a selected device, it also becomes disorganized and unsightly to have so many small appliances cluttering one area of the kitchen. One recent attempt to solve this problem has been to provide a kitchen counter space with what is known as an appliance garage, wherein the various small devices can be stored on the kitchen counter behind a roll-down type of mini-garage door which extends from just beneath a kitchen cupboard above the counter and down to the counter surface so as to hide the small appliances situated on the counter behind the roll down door. However, this does not solve the problem of providing an easy means for using a particular appliance as the appliance must first be handled so as to remove it from the "appliance garage" or other storage location and then moved to a location near an electrical outlet for use. Additionally, this does not solve the problem of the repeated wear and tear on the electrical cord of the small kitchen appliance necessitated by its having to be moved to counter space near an electrical outlet and plugged in for use and then unplugged and put back in its storage area.

It would therefore be beneficial to provide a holder for numerous small electrical appliances that can be located near an electrical outlet and which allows for neat display of the various electrical devices and easy use. It would also be advantageous if this holder occupied a minimal amount of space within the kitchen and were easy to install. It would also be highly advantageous to provide a holder which accomplishes all of the above and yet which allows each small kitchen appliance to be easily and selectively used without much handling of the appliance. Finally, it would also be highly advantageous and a great time saver to provide such a rotatable holder that allows each small kitchen appliance to remain plugged in and ready for use, thereby reducing wear and tear on an appliance's electrical cord and further, allowing a person to use more than one appliance simultaneously. The holder of the present invention is designed specifically to overcome the problems known in the art and to provide such benefits.

SUMMARY OF THE INVENTION

The present invention relates to a rotatable holder for supporting numerous small kitchen appliances in a sturdy and storage-efficient manner, to allow for rotation of the holder so as to facilitate use of one or more selected appliances thereon and to allow each small kitchen appliance to remain plugged in and ready for use. The holder of the present invention comprises a base, a circular tray structured and adapted to be positioned on top of the base and rotated relative thereto, and means for rotatably connecting the tray to the base. The connecting means of the holder include means for receiving a supply of electrical power through the base and for transmitting the electrical power to the tray, which includes an upstanding electrical core mounted to an upper surface and generally about a center thereof. The upstanding electrical core is in electrical communication with the connecting means and has a diameter smaller than a diameter of said tray, and further, includes a plurality of electrical outlets operably connected thereto and in electrical communication therewith. Each of the plurality of electrical outlets is axially disposed about the core a pre-determined distance above the tray. In this way, the invention is structured and configured to receive a supply of electrical power for providing electricity to the invention in its assembled form, namely, through the base and connecting means, into the upstanding electrical core of the tray, and finally, to the plurality of electrical outlets. Preferably, the invention further includes a switch, ideally mounted to the upstanding electrical core so that a supply of electrical power can be received by and to provide energy to each of the plurality of electrical outlets of the electrical core. It will therefore be appreciated that a number of small kitchen appliances may be stored on the tray of this invention and that each appliance may remain plugged in to one of the plurality of electrical outlets, ready for use when the switch is turned to a position so as to allow the invention to become energized.

An object of the present invention is to provide a holder for numerous small electrical appliances which supports them in a sturdy manner.

Yet another object of the present invention is to provide a holder for numerous small electrical appliances which is rotatable so as to facilitate use of a small electrical appliance supported thereon.

Another object of the present invention is to provide a rotatable holder that allows a small kitchen appliance supported thereon to be easily and selectively used without much handling of the appliance.

A feature of the present invention for a rotatable holder is that it includes a plurality of electrical outlets thereon so that each small kitchen appliance supported thereon can remain plugged in and ready for use.

An advantage of the present invention is that it will thereby reducing wear and tear on the appliance's electrical cord.

Another advantage of the present invention is that it allows a person to use or otherwise operate one or more of the small kitchen appliances supported on the holder at the same time.

Another feature of the present invention is that it reduces the safety hazard associated with the lengths of electrical cord associated with each small appliance, which can either be permanently shortened or kept neatly coiled and tied so as to have only a short electrical cord length.

Yet another object of the present invention is to provide a holder which allows for neat display of several small, electrical appliances supported thereon and yet which occupies a minimal amount of space within the kitchen.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
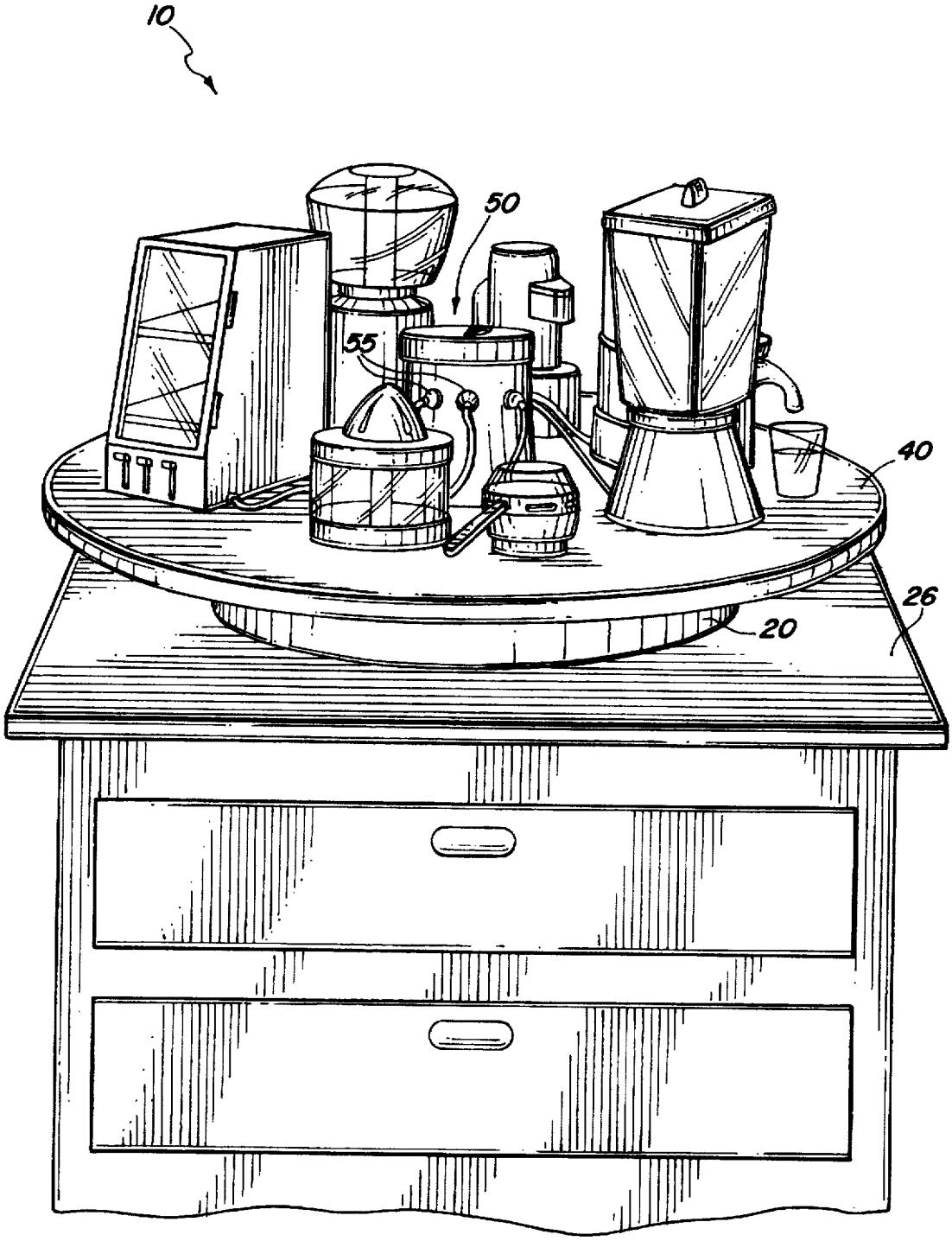
FIG. 1 is a perspective view of a rotatable holder according to this invention shown in assembled form and with a number of small kitchen appliances supported thereon.

Shown throughout FIGS. 1–12, the present invention is directed towards a rotatable holder for small electric kitchen appliances, and is generally indicated as 10. The rotatable holder 10, as best illustrated in FIG. 1, is seen to comprise a circular base 20 and a circular tray 40, and also includes means for connecting the tray to the base 20 and for allowing the tray 40 to rotate relative thereto.

As illustrated throughout the Figures, the rotatable holder of this invention comprises a base 20, which in the preferred embodiment is circular. Base 20 may be formed of any suitable rigid material such as wood, metal or a heavy, molded plastic material. As described, the rotatable holder of this invention 10 also comprises means for rotatably connecting the tray 40 to the base 20, which connecting means include means for receiving a supply of electrical power through the base and for transmitting the supply of electrical power to the tray. The connecting means are preferably in the form of mating male and female structure formed on the base 20 and tray 40, as is about to be described.

Figure 2:
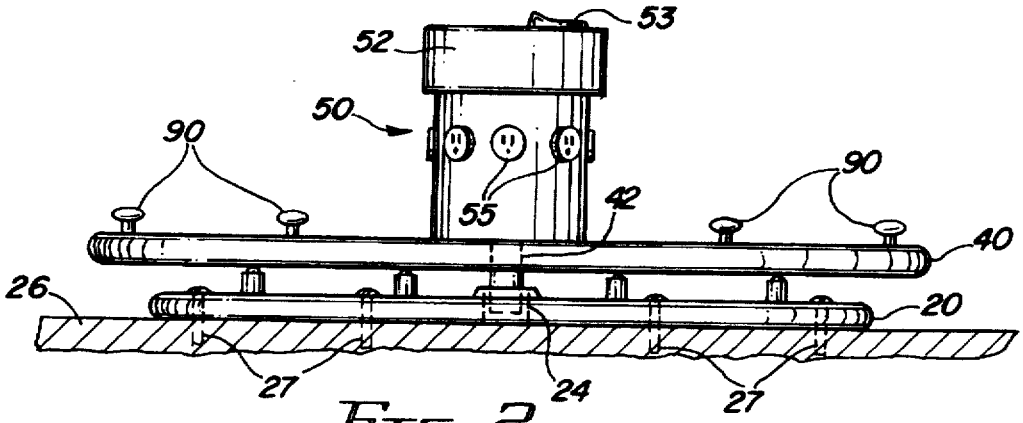
FIG. 2 is a side view of the preferred embodiment of the invention, shown in assembled form with connecting means between the base and tray illustrated in hidden lines.
Figure 3:
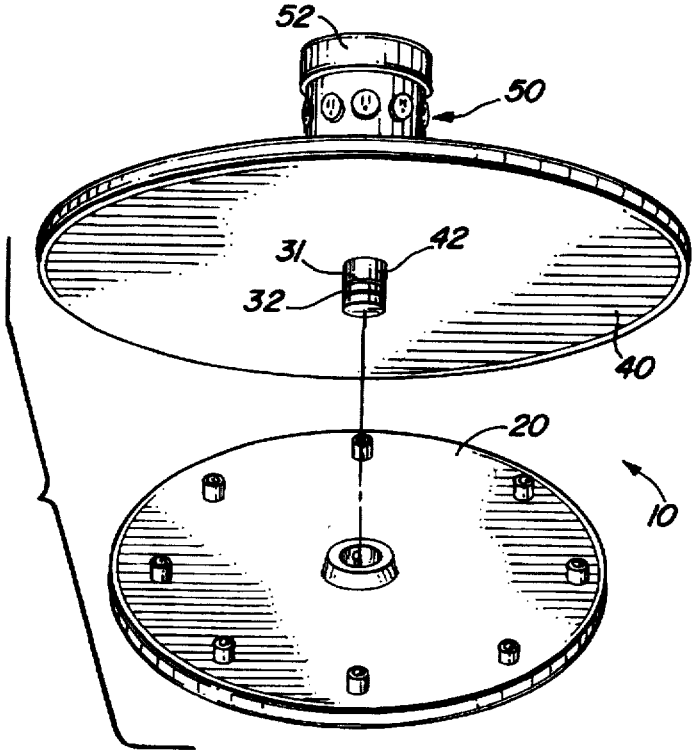
FIG. 3 is a perspective view of the invention shown in FIG. 2, showing the base separated from the circular tray.
Figure 6:
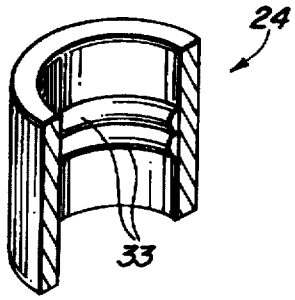
FIG. 6 is a partial cut away view of the female connector of the base, showing an alternative means of transmitting power to the tray and upstanding electrical core.
Figure 4:
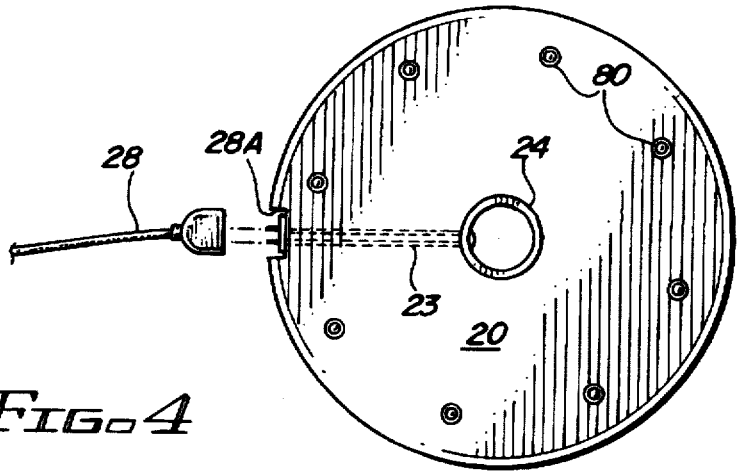
FIG. 4 is a view showing the undersurface of the circular base shown in FIG. 2 and illustrating means for supplying power to the invention.
Figure 5:
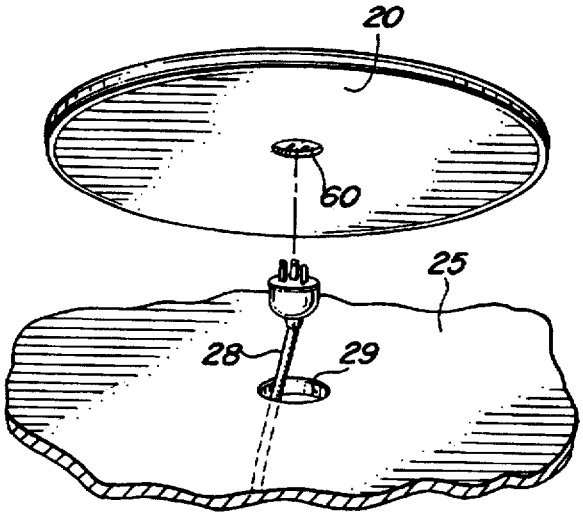
FIG. 5 is a perspective view showing an alternative embodiment for the undersurface of the base of this invention and illustrating a platform or kitchen counter with means for supplying power to the invention.

Referring now to FIGS. 2 and 3, in the preferred embodiment, circular base 20 is seen to include a female connector 24 which is formed generally about a center point within the circular base 20. The female connector 24 is a hollow tubular member of a diameter substantially smaller than the diameter of circular base 20. Additionally, circular base 20, including female connector 24 are structured to provide a supply of electrical power to the overall system. For example, as shown in FIG. 4, circular base 20 can be formed to have a tunnel 23 extending axially within the base which connects to a lower end of female connector 24 for allowing an electrical lead wires to pass therethrough, namely, a positive and a negative lead wire which can be selectively connected to the electrical cord 28 to supply power to the female connector 24. As shown in FIG. 5, circular base 20 can alternatively be formed to have a circular recess 60 therein, which corresponds the location of female connector 24 and which includes structure for electrical connection of an electrical cord 28, so as to energize a positive and a negative lead wire extending to and connected with female connector 24. In either case, it will be appreciated that female connector 24, which may even take the form of a socket, is structured to be energized by a supply of electrical power. Further, female connector 24 includes means for transmitting the supply of electrical power to an upstanding electrical core 50 on the circular tray 40. These means may comprise at least one and preferably a pair of bulging members b1, b2, which protrude axially into the hollow interior of female connector 24 so as to contact male connector 42, made of metal, once the rotatable holder 10 is assembled, and that as tray 40 is rotated, male connector 42 secured thereto also rotates but that bulging members b1, b2 continuously contact male connector 42 about a paths 31, 32, respectively, as shown in FIG. 3. In the preferred embodiment, one of the bulging members b1 is structured and adapted to receive positive energy from positive lead wire of electrical supply source 28 and to provide positive energy to male connector 42 of tray 40, while bulging member b2 is structured and adapted to do the same with negative energy. It will be appreciated by those skilled in the art that the hollow interior end of female connector 24 can be provided with other conventionally known structure for accomplishing this same purpose, such as a pair of beaded rims 33 about an inner periphery thereof, as illustrated in FIG. 6.

Figure 7:
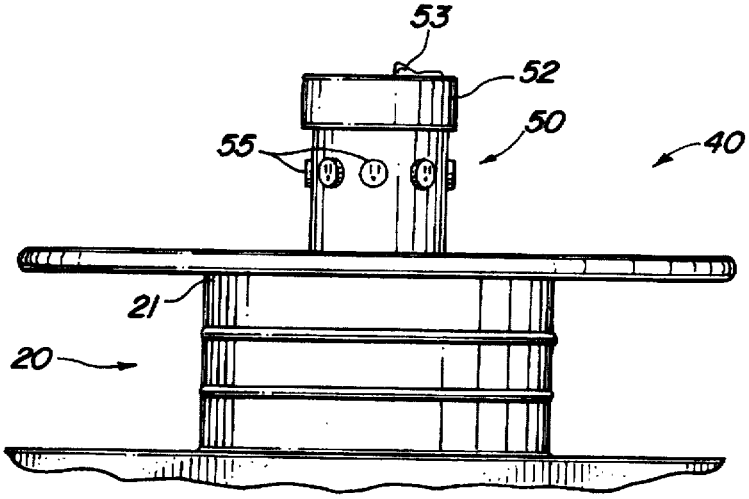
FIG. 7 is a side view of an alternative embodiment of the invention illustrated in assembled form.
Figure 8:
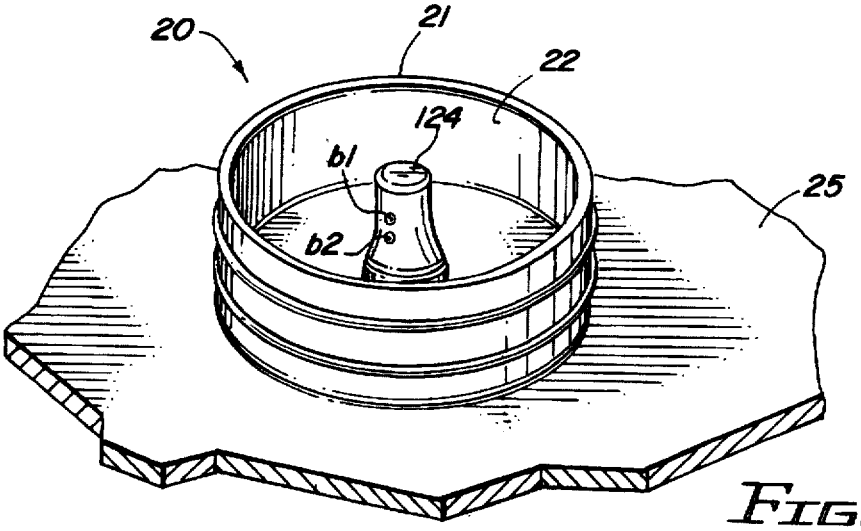
FIG. 8 is a top perspective view of the circular base of the invention shown in FIG. 7.
Figure 9:
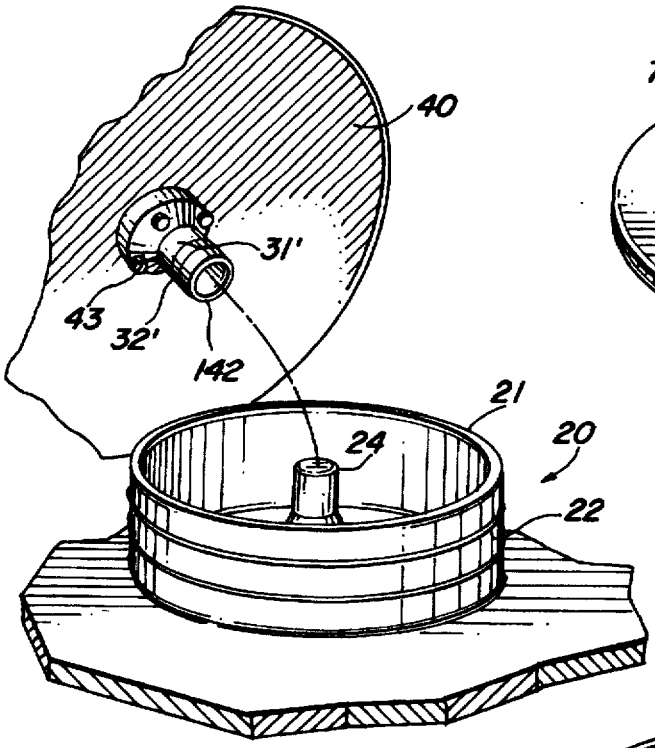
FIG. 9 is a perspective view showing a partial undersurface of the circular tray of the invention shown in FIG. 7, in about to be assembled form and illustrating a female connector mounted to the circular tray.

In an alternative embodiment and as illustrated in FIGS. 7–9, circular base 20 of the holder 10 is seen to be defined by a floor member 25 and an upstanding surrounding sidewall structure 22 connected thereto, forming a generally hollow interior of the base. Mounted within the hollow interior is an upstanding tubular member 124, which is secured generally about a center point of the hollow circular base. Upstanding tubular member 124 has the structure of a male connector, and further, is seen to be of a diameter substantially smaller than the diameter of the circular base. Like female connector 24, upstanding male tubular member 124 is structured to receive a supply of electrical energy and further, includes means for transmitting electrical energy to circular tray 40. The transmitting means may comprise a pair of bulging members b1, b2 which protrude axially outwardly from the circumference of upstanding tubular member 124 so as to contact female connector 142, made of metal, once the rotatable holder 10 is assembled, and that as tray 40 is rotated, female connector 142 shown in FIG. 9 secured thereto also rotates but that bulging members b1, b2 continuously contact female connector 142 about paths 31', 32', respectively. Preferably, bulging member b1 is structured and adapted to provide positive energy to the system from the electrical supply source and the other bulging member b2 is structured and adapted to provide negative energy to the system. It will be appreciated by those skilled in the art that the lower, hollow interior end of male connector member 124 can be provided with other conventionally known structure for accomplishing this same purpose, such as a pair of beaded rims extending about a periphery thereof.

Referring now to FIG. 5, it is seen that circular base 20 may be fastened to a flat platform 25 by way of conventionally known fasteners 27. This platform 25 may then be secured directly to a counter surface 26 in the kitchen although it will be understood that the kitchen counter itself could also serve as the platform. As has been described, base 20 is structured to receive an electrical supply source 28 for providing electric energy to the invention and as illustrated in FIG. 5, platform 25 and/or counter 26 may have an aperture 29 formed therein, so as to allow electrical supply cord 28 to enter underneath the counter and exit through aperture 29 for direct connection to the mating electrical connector within aperture 60 of base 20. In this way, cord 28 will not cause any rocking of platform 25 on counter surface 26. Of course, a more preferred embodiment for the base has been illustrated in FIG. 4, wherein an opening is formed in a peripheral edge of circular base 20 and within which the conventionally known structure for connection of the electric energy thereto is positioned. In this more preferred embodiment, the base 20 is smaller in relation to tray 40, so that should any spillage of fluids occur during use of an appliance supported on tray 40, opening 28*a* and the electrical structure therein will not be affected.

The rotatable holder of this invention further includes a tray 40, illustrated in FIGS. 1–3 and 7. Tray 40 is preferably circular and further, is structured and adapted to be positioned on top of the base 20 and rotated relative thereto. In the preferred embodiments, circular tray 40 has a diameter which is larger than that of circular base 20 although it will be appreciated that the spirit and function of this invention would be met if the tray were of an equal or smaller diameter than that of base 20. However, by structuring the diameter of circular tray 40 so as to be larger than that of base 20, two advantages are offered, namely, that a relatively large upper surface area is provided for holding numerous small kitchen appliances, and that any spillage or run-off of fluids from an appliance on tray 40 will not drip onto base 20.

Referring now to FIG. 2, in the preferred embodiment circular tray 40 is seen to include a male connector 42 secured to an underside surface of the tray 40, preferably about a center or rotational axis thereof. Male connector 42 is seen to extend from the tray 40 at a substantially right angle and is structured, sized and configured for being snugly fit into the female connector 24 of base 20. It will be appreciated that female connector 24 is of sufficient depth to receive a sufficient length of the upstanding male connector 42 so as to provide a sturdy interconnection of the tray and the base. In the alternative embodiment illustrated in FIGS. 7–9, circular tray 40 is seen to include a female connector 142 secured to an underside surface of the tray 40, also about a center thereof. Female connector 142 is also seen to extend away from the tray 40 at a substantially right angle and can be secured to the underside of tray 40 by conventionally known fasteners, 43. In this embodiment, female connector 142 is structured, sized and configured for being snugly fit onto the upstanding male connector tubular member 124 of base 20. Here also, female connector 142 is of sufficient depth to receive a sufficient length of the upstanding male connector 124 so as to provide a sturdy interconnection of the tray and the base.

As best illustrated in FIG. 2, when the rotatable holder of this invention is assembled, tray 40 will be most preferably be positioned at a height of about one to three inches above stationary circular base 20, platform 25 and/or counter 26 so as to offer a compactly sized holder which is less intrusive of kitchen space. It will be appreciated that tray 40 could be positioned at other heights above base 20. For example, in the alternative embodiment shown in FIGS. 7 and 8, the surrounding sidewall structure 22 of base 20 defines a rim 21, and here, the height of surrounding sidewall structure 22 will determine the distance from platform 25 to tray 40, and that this distance can vary by varying the height of sidewall structure 22, which preferably will not exceed six inches. In this embodiment, rim 21 may provide support for circular tray 40 in that rim 21 may contact the undersurface of tray 40 although such feature will hinder the rotatability of tray 40. In this manner, many small kitchen appliances may be placed on the upper surface of tray 40 and these will be sturdily supported thereon without any tilting of the circular tray 40.

Figure 10:
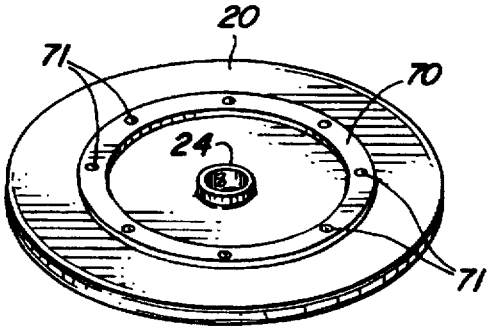
FIG. 10 is a perspective view showing a means for rotating the circular tray of this invention relative to the stationary base.

So as to facilitate rotation of tray 40 relative to base 20, the invention will preferably include means for rotating, which in a more preferred embodiment, comprise an annular member 70, as shown in FIG. 10, disposed in spaced axial relation to female connector 24 of said circular base 20. As illustrated, annular member may include a plurality of ball bearings 71 disposed therein. Annular member 70 is positioned between base 20 and tray 40 and is structured to contact both base upper surface and tray under surface so as to permit and facilitate rotation of tray 40. In a more preferred embodiment shown in FIG. 3, the means for rotating will further comprise a plurality of upstanding legs 80, operably connected to base 20. Each upstanding leg 80 is of a uniform height and includes a ball bearing connected thereto to facilitate the rotation of tray 40 supported thereon. As illustrated in FIG. 3, upstanding leg members 80 are secured by conventionally known fasteners to base 20 and are ideally positioned along a circular pattern on base 20 which generally corresponds to the periphery of circular tray 40. Further, each leg member is of a height equal to the distance between the upper surface of base 20 and the under surface of tray 40. In this way, the upstanding members 80 are structures which prevent the tilting of the tray 40. Of course, it will be appreciated that the upstanding leg members may be secured to platform 25 instead of to base 20 to achieve the same purpose.

In a preferred embodiment shown in FIG. 2, circular tray 40 includes handle means which allow a user to easily rotate tray 40 relative to base 20 or counter 26. Preferably, the handle means comprise a plurality of knobs 90 operably connected to the tray 40 by way of conventionally known fasteners and positioned about a periphery of tray 40. Ideally, each knob 90 itself can rotate relative to tray 40 so that as a user pulls and/or pushes on a knob for causing rotation of tray 40, there will be minimal friction force exerted by the user's fingers on the knob 90 as the tray rotates and the point of the tray 40 corresponding the knob travels in an arcuate path.

Figure 11:
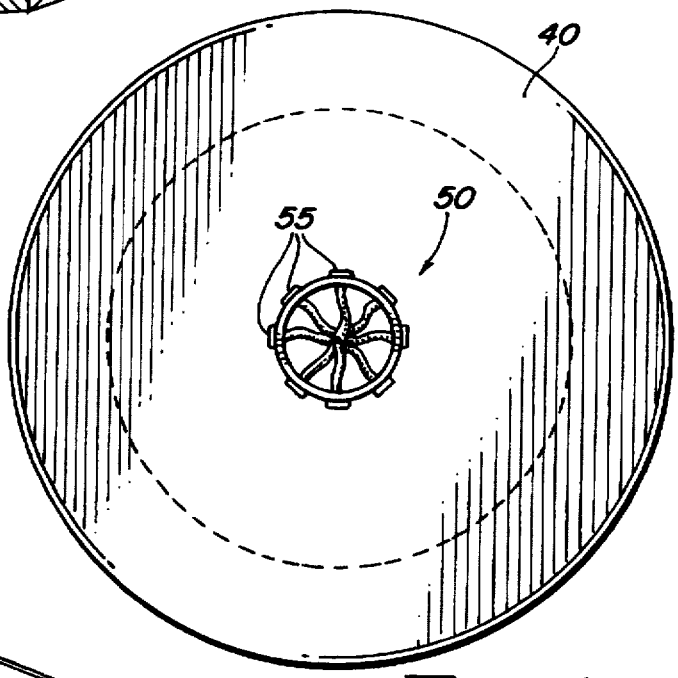
FIG. 11 is a top view of the upstanding electrical core of this invention with a top thereof having been removed.

Referring now to FIGS. 1–3 and 7, circular tray 40 is seen to include an upstanding electrical core 50 comprised of a second tubular member mounted to an upper surface of circular tray 40 generally about a center thereof. This upstanding electrical core 50 is in electrical communication with male connector 42 and/or female connector 142, and further, has a diameter substantially smaller than that of the tray 40. As will be noted from the drawings, electrical core 50 is provided with a plurality of electrical outlets, 55 operably connected to the second tubular member. Thus, and as illustrated in FIG. 11, electrical core 50 has a hollow interior so as to act as a housing for the wiring associated with each of electrical outlets 55 and that to serve this purpose, electrical core 50 is ideally of a height of between ten to twelve inches and of a diameter of about four to six inches. It will also be understood that because of the snug mating fit between female connector 24 of base 20 and male tubular member 42 of tray 40, the bulging members b1, b2 will contact male tubular member 42, which is made of a metallic material, about a periphery thereof and that this action will transmit the electrical power from electrical supply cord 28 into base 20, through and across connector 24 which transmits the energy to male tubular member 42 and into electrical core 50. In alternative embodiments, it is understood that because of the snug mating fit between upstanding male tubular member 124 of base 20 and female connector 142 of tray 40, the bulging members b1, b2 of male tubular member 124, which is made of a metallic material, will contact the female connector 142 about an inner periphery thereof and that this action will transmit the electrical power from electrical supply cord 28 into base 20, through and across upstanding male member 124 which transmits the energy to female connector 142 and into electrical core 50.

As illustrated throughout the Figures, the electrical outlets 55 are arranged on the electrical core at a height above and preferably substantially above, the circular tray. Those skilled in the art will appreciate that this feature will avoid short circuits in and/or shocks in the system which may result from a foreseeable spillage of fluids during operation of a small kitchen appliance situated on circular tray 40. Should such spillage occur, outlets 55 will not be affected as any such fluids will not be able to flow into the outlets but rather will pool on the circular tray 40 or drip off of tray 40 onto the counter surface 26. In a most preferred embodiment, the electrical outlets 55 will be arranged about a circumference of electrical core 50 as illustrated in the drawings.

Figure 12:
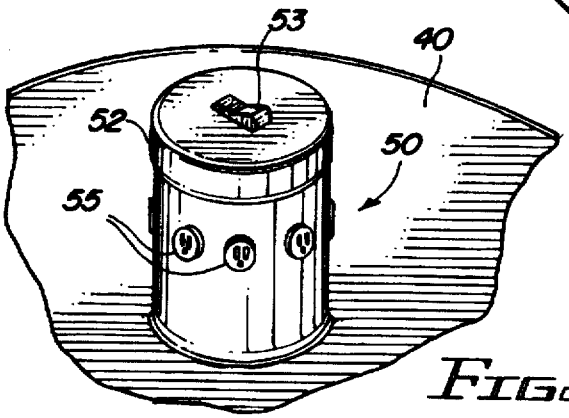
FIG. 12 is a close up perspective view of the invention shown in FIG. 1, illustrating the upstanding electrical core mounted to a top of the circular tray.

In addition, electrical core 50 may include an electrical switch 53, which will preferably mounted to a top 52, of the electrical core as shown in FIG. 12. When the switch is moved to a closed position, the system will be provided with electricity. As has been explained, the invention is structured to provide electricity to each of said plurality of electrical outlets. When the switch 53 is moved to an open position, the circuit is not completed and thus electricity is not flowing throughout. Thus, each small kitchen appliance may remain plugged in and is easily ready for use by a simple touch of the switch to energize the invention. Finally, electrical core 50 may also include a power surge protector as well as a circuit breaker for emergency use. For example, should too many appliances supported on and plugged into the holder be in use at one time, the electrical system may become overloaded, in which case the circuit breaker will act to automatically switch the system to an open position wherein the circuit is not completed and electricity in not running through the system.

Turning to the use of the rotatable holder, it will be seen to offer numerous advantages. As one example, this discussion will outline the steps a user might take in preparing a breakfast. First, the user would select an small kitchen appliance for use, which may be a coffee maker and by grasping the knob nearest him, the user may easily rotate tray 40 relative to base 20 so as to bring this appliance into the desired position proximal to user for its operation. After inserting the filter, the coffee to be brewed, and water into the selected coffee machine, the user may then turn the coffee machine switch to "on" and allow brewing to begin. The user is now free to select a second appliance, for instance a toaster, and the tray may again be rotated to bring this appliance into the desired position proximal to user for its operation, while the coffee machine is brewing coffee simultaneously. After inserting the bread to be toasted, the user may then depress the toaster switch to allow toasting to begin. The user is now free to select yet another appliance, for instance a juice maker, and tray 40 may again be rotated to bring this appliance into the desired position proximal to user for its operation. The user is thus free to prepare in the juice maker, e.g., fresh orange juice at the same time that the coffee machine is brewing and the toaster is operating. Thus, the rotatable holder of this invention is seen to save the user time, and further, to save storage space and unnecessary handling of each appliance.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A rotatable holder for small electrical kitchen appliances., comprising:

a) a circular base, including a hollow tubular member secured generally about a center of said circular base, said hollow tubular member defining a female connector and having a diameter substantially smaller than a diameter of said circular base;

said hollow tubular member including a passageway for receiving a supply of electrical power and means on said hollow tubular member for transmitting the supply of electrical power comprising at least one bulging member secured to and protruding from an inner surface of said hollow female connector and into an interior thereof;

b) a circular tray structured and adapted to be positioned on top of said circular base and rotated relative to said circular base, said tray including;

i) a male connector secured to an undersurface of said tray generally about a center of said tray and extending away from said tray at a substantially right angle; said male connector being sized, dimensioned and configured for snug fitting into said hollow tubular female connector of said base; said male connector further including means for receiving a supply of electrical power and a passageway for transmitting said supply of electrical power;

ii) an upstanding electrical core comprised of a second tubular member mounted to an upper surface of said circular tray generally about a center of said tray, said electrical core being in electrical communication with said male connector and having a diameter substantially smaller than a diameter of said tray, said electrical core including a plurality of electrical outlets operably connected thereto and an electrical switch mounted to said electrical core, said electrical outlets disposed at a height substantially above said circular tray;

c) means for supplying electrical power to said base for providing electricity to said female connector, across said male connector and into said upstanding electrical core and to said plurality of electrical outlets when said switch is turned to a closed position, and d) means for rotating said tray relative to said base.

2. A rotatable holder as recited in claim 1 wherein said means for rotating comprise an annular member disposed in spaced axial relation to said upstanding electrical core of said base and disposed between said tray and said base, said annular member having a height sufficient to contact both said base and said tray, and including a plurality of ball bearings disposed therein.

3. A rotatable holder as recited in claim 1 wherein said means for rotating comprise a plurality of upstanding legs connected to said base along a circular path thereon to correspond the periphery of said circular tray supported above said base, and a ball bearing disposed on each of said upstanding leg members.

4. A rotatable holder as recited in claim 1 wherein said upstanding electrical core is of a height generally between six and twelve inches and has a diameter of about six inches.

5. A rotatable holder as recited in claim 1 wherein said diameter of said base is greater than a diameter of said tray.

6. A rotatable holder as recited in claim 1 wherein said base includes a passageway for receiving a supply of electrical power and said passageway communicates with said passageway of said female connector.

7. A rotatable holder as recited in claim 1 wherein said passageway of said base includes an open mouth at a peripheral edge and said base includes an electrical connector plug positioned within said open mouth of said passageway so that a mating electrical connector from an electrical supply cord can be joined thereto.

8. A rotatable holder for small electric kitchen appliances, comprising:

a) a circular base, including a level floor member, an upstanding surrounding sidewall structure of a uniform height connected to said floor member and defining a hollow interior within said base;

an upstanding tubular member secured generally about a center of said floor member of said circular base, said upstanding tubular member defining a male connector and further having a diameter substantially smaller than a diameter of said circular base; said upstanding tubular member including a passageway for receiving a supply of electrical power and means on said upstanding tubular member for transmitting the supply of electrical power;

b) a circular tray positioned on top of said circular base and structured to be rotated relative to said circular base, said tray including:

i) a female connector secured to an under surface of said tray generally about a center of said tray and extending away from said tray at a substantially right angle; said female connector being hollow and sized, dimensioned and configured for snug yet rotatable fitting onto said upstanding male connector tubular member of said base and being of sufficient depth to receive a sufficient length of said male connector therein; said female connector further including means for receiving a supply of electrical power and a passageway for transmitting said supply of electrical power;

ii) an upstanding electrical core comprised of a second tubular member having a height generally between six and twelve inches and having a diameter of about six inches, said upstanding electrical core being mounted to an upper surface of said circular tray generally about said center of said tray and being in electrical communication with said female connector, said electrical core including a plurality of electrical outlets operably connected thereto, each one of said plurality of electrical outlets being arranged on said electrical core at a height substantially above said circular tray and an electrical switch mounted to said electrical core; and c) means for supplying electrical power to said upstanding electrical core and said plurality of electrical outlets when said switch is turned to a closed position.

9. A rotatable holder as recited in claim 8 further comprising means for rotating said tray relative to said base.

10. A rotatable holder as recited in claim 9 wherein said means for rotating comprise a plurality of upstanding legs connected to said base along a circular path thereon to correspond the periphery of said circular tray supported above said base, and a ball bearing disposed on each of said upstanding leg members.

11. A rotatable holder as recited in claim 10 wherein each of said plurality of upstanding legs are of a uniform height of between two and six inches.

12. A rotatable holder as recited in claim 8 wherein said upstanding surrounding sidewall structure is of a height generally between two to six inches.

13. A rotatable holder as recited in claim 8 wherein said circular base has said diameter of about twelve inches and said circular tray has a diameter of generally about twenty-four inches.

14. A rotatable holder as recited in claim 8 wherein said means for transmitting said supply of electrical power from said upstanding tubular member comprise at least one bulging member secured to and protruding from an outer circumference of said upstanding tubular member.

15. A rotatable holder as recited in claim 8 wherein said base includes a passageway for receiving a supply of electrical power and said passageway communicates with said passageway of said upstanding tubular member.

16. A rotatable holder as recited in claim 15 wherein said passageway of said base comprises an aperture formed in an undersurface of said base generally under said upstanding tubular member and an electrical connector plug positioned within said aperture so that a mating electrical connector from an electrical supply cord can be joined thereto.

17. A rotatable holder as recited in claim 8 wherein said uniform surrounding sidewall structure of said base has a height of generally between two and six inches.

18. A rotatable holder for small electrical kitchen appliances, comprising:

a) a circular base, including a hollow tubular member secured generally about a center of said circular base, said hollow tubular member defining a female connector and having a diameter substantially smaller than a diameter of said circular base;

said hollow tubular member including a passageway for receiving a supply of electrical power and means on said hollow tubular member for transmitting the supply of electrical power comprising at least one beaded rim secured to and protruding from an inner surface of said hollow female connector and into an interior thereof;

b) a circular tray structured and adapted to be positioned on top of said circular base and rotated relative to said circular base, said tray including;

i) a male connector secured to an undersurface of said tray generally about a center of said tray and extending away from said tray at a substantially right angle; said male connector being sized, dimensioned and configured for snug fitting into said hollow tubular female connector of said base; said male connector further including means for receiving a supply of electrical power and a passageway for transmitting said supply of electrical power;

ii) an upstanding electrical core comprised of a second tubular member mounted to an upper surface of said circular tray generally about a center of said tray, said electrical core being in electrical communication with said male connector and having a diameter substantially smaller than a diameter of said tray, said electrical core including a plurality of electrical outlets operably connected thereto and an electrical switch mounted to said electrical core, said electrical outlets disposed at a height substantially above said circular tray;

c) means for supplying electrical power to said base for providing electricity to said female connector, across said male connector and into said upstanding electrical core and to said plurality of electrical outlets when said switch is turned to a closed position, and d) means for rotating said tray relative to said base.

* * * * *